US005561505A

United States Patent [19]

Lewis

[11] Patent Number: 5,561,505

[45] Date of Patent: Oct. 1, 1996

[54] MECHANICALLY SEALABLE LIQUID CHARGING APPARATUS

[75] Inventor: Richard B. Lewis, Williamson, N.Y.

[73] Assignee: Xerox Corporation, Stamford, Conn.

[21] Appl. No.: 551,637

[22] Filed: Nov. 1, 1995

[51] Int. Cl.[6] ..... G03G 15/02

[52] U.S. Cl. ..... 355/219; 361/225

[58] Field of Search ..... 355/219, 200, 355/210; 430/902; 361/225

[56] References Cited

U.S. PATENT DOCUMENTS 4,064,514 12/1977 Gundlach .

*Primary Examiner*—R. L. Moses
*Attorney, Agent, or Firm*—Denis A. Robitaille

[57] ABSTRACT

An apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a mechanically sealable housing adapted to permit movement of the wetted donor blade from an operative position in contact with the charge retentive surface, to a nonoperative position stored within the housing to prevent loss of the ionically conductive liquid in its liquid or vapor form so as to extend the functional life of the apparatus. In one specific embodiment, a wiper blade may be provided for removing any liquid droplets from the surface of the photoreceptor as may have been transferred at the donor blade/charge retentive surface interface.

19 Claims, 3 Drawing Sheets

MECHANICALLY SEALABLE LIQUID CHARGING APPARATUS

The present invention relates generally to a charging apparatus for enabling ion transfer via ionic conduction through an ionically conductive liquid, primarily for use in electrostatographic applications, for example, for charging an imaging member such as a photoreceptor or a dielectric charge receptor and, more particularly, concerns a liquid charging device of the type described hereinabove, having a moisture tight mechanical seal for preventing escape of liquid from the charging apparatus.

Generally, the process of electrostatographic reproduction is initiated by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original document on the photoreceptive member. This latent image is subsequently developed into a visible image by a process in which a charged developing material is deposited onto the photoconductive surface such that the developing material is attracted to the charged image areas on the photoreceptor. Thereafter, the developing material is transferred from the photoreceptive member to a copy sheet or some other image support substrate to which the image may be permanently affixed for producing a reproduction of the original document. In a final step in the process, the photoconductive surface of the photoreceptive member is cleaned to remove any residual developing material therefrom in preparation for successive imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, in contradistinction to the light lens generated image systems which develop toner on the charged areas, known as CAD, or "write white" systems the subject invention applies to both such systems.

Various devices and apparatus are known for applying a uniform electrostatic charge or charge potential to a photoconductive surface prior to the formation of the latent image thereon. Typically, a well-known corona generating type device is utilized for applying charge to the photoreceptor, wherein a suspended electrode comprising one or more fine conductive elements is biased at a high voltage potential, causing ionization of surrounding air which results in deposition of an electric charge on an adjacent surface, namely the photoreceptor. In addition to charging the imaging surface of an electrostatographic system prior to exposure, corona generating devices of the type described, or so-called corotrons, can be used in the transfer of an electrostatic toner image from a photoreceptor to a transfer substrate, in tacking and detacking paper to or from the imaging member by neutralizing charge on the paper, and, generally, in conditioning the imaging surface prior to, during, and after the deposition of toner thereon to improve the quality of the xerographic output copy produced thereby. Each of these functions can be accomplished by a separate and independent corona generating device. The relatively large number of devices within a single machine necessitates the economical use of corona generating devices.

Several problems have historically been associated with corona generating devices. The most notable problem centers around the inability of such corona devices to provide a uniform charge density along the entire length of the corona generating electrode, resulting in a corresponding variation in the magnitude of charge deposited on associated portions of the adjacent surface being charged. Other problems include the use of very high voltages (6000–8000 V) requiring the use of special insulation, inordinate maintenance of corotron wires, low charging efficiency, arcing caused by non-uniformities between the coronode and the surface being charged, vibration and sagging of corona generating wires, contamination of corona wires, and, in general, inconsistent charging performance due to the effects of humidity and airborne chemical contaminants on the corona generating device. More importantly, corotron devices generate ozone, resulting in well-documented health and environmental hazards. Corona charging devices also generate oxides of nitrogen which eventually desorb from the corotron and oxidize various machine components, resulting in an adverse effect on the quality of the final output print produced thereby.

Various approaches and solutions to the problems inherent to the use of suspended wire corona generating charge devices have been proposed. For example, U.S. Pat. No. 4,057,723 to Sarid et al. shows a dielectric coated coronode uniformly supported along its length on a conductive shield or on an insulating substrate. That patent shows a corona discharge electrode including a conductive wire coated with a relatively thick dielectric material, preferably glass or an inorganic dielectric, in contact with or spaced closely to a conductive shield electrode. U.S. Pat. No. 4,353,970 discloses a bare wire coronode attached directly to the outside of a glass coated secondary electrode. U.S. Pat. No. 4,562,447 discloses an ion modulating electrode that has a plurality of apertures capable of enhancing or blocking the passage of ion flow through the apertures. In addition, alternatives to corona generating charging systems have been developed. For example, roller charging systems, as exemplified by U.S. Pat. Nos. 2,912,586 to Gundlach; U.S. Pat. No. 3,043,684 to Mayer; U.S. Pat. No. 3,398,336 to Martel et al., have been disclosed and discussed in numerous articles of technical literature.

The present invention relates to a device for charging photoconductive imaging members via ionic conduction through a fluid or liquid media such as water, wherein corona generating devices and other known devices for inducing a charge on an adjacent surface, together with their known disadvantages, can be avoided. In particular, the present invention is directed toward a mechanically sealable liquid charging apparatus, wherein the escape of liquid can be controlled to prevent loss thereof, especially during periods of non-charging. The following disclosures may be relevant to various aspects of the present invention:

U.S. Pat. No. 2,904,431 Patentee: Moncrieff-Yeates Issued: Sep. 15, 1959

U.S. Pat. No. 2,987,660 Patentee: Walkup Issued: Jun. 6, 1961

U.S. Pat. No. 3,394,002 Patentee: Bickmore Issued: Jul. 23, 1968

U.S. Pat. No. 5,457,523 Patentee: Facci et al. Issued: Oct. 10, 1995

Japanese Patent Application Document No.: 59-61858 Inventor: Itaya Publication Date: Apr. 9, 1984

Japanese Patent Application Document No.: 04-109262 Inventor: Haneda Publication Date: Apr. 10, 1992

Japanese Patent Application Document No.: 05-297683 Inventor: Miyaki Publication Date: Nov. 12, 1993

U.S. patent application Ser. No.: 08/497,987 Inventor: Facci et al. Filing Date: Jul. 3, 1995

The relevant portions of the foregoing disclosures may be briefly summarized as follows:

U.S. Pat. No. 2,904,431 discloses a method and apparatus for providing electrical connection to a body of semi-conductive or dielectric material, wherein the method comprises closely spacing the surface of an electrode from the surface of the body to which connection is to be made with a film forming liquid. When a voltage is applied to the electrode, an electric field is generated across the liquid film, causing the liquid to behave as a conductor transversely through the layer while continuing to behave as an insulator in the lateral direction. That patent includes a method of electrically charging the surface of a body of semi-conductive or dielectric material.

U.S. Pat. No. 2,987,660 discloses a xerographic charging process for applying an electric charge to the surface of an insulating or photoconductive insulating layer by electrification with a conductive or electrolytic liquid wherein the charge applied is of substantially the same potential as the potential on the contacting liquid and is substantially uniform across the entire area being charged.

U.S. Pat. No. 3,394,002 discloses a method of applying charge onto an electrically insulating surface utilizing a liquid of high resistivity across which an electrostatic image is transferred. More particularly, that patent relates to the chemical doping of liquid materials utilized in various electrostatic imaging systems whereby the electrical charge transfer characteristics thereof are controlled for effecting image charge transfer between juxtaposed surfaces of different imaging materials.

U.S. Pat. No. 5,457,523 discloses a device for applying an electrical charge to a charge retentive surface by transporting ions in a fluid media and transferring the ions to the member to be charged. The fluid media is a ferrofluid material wherein a magnet is utilized to control the position of the fluid media, which in turn can be utilized to selectively control the activation of the charging process.

Japanese Patent Application Document No. 59-61858 discloses a charging/discharging device comprising ferromagnetic metal fluid retained in a magnetic field formed by a magnetic field generation means. The features of the structure described in that publication are attained by bringing ferromagnetic metal fluid into direct contact with the surface of an insulator to be charged or discharged, whereby the ferromagnetic fluid is maintained at an electrode section through magnetism for contacting the insulator to be charged or discharged. Magnetic bodies are mounted on both sides of a rotatable magnet, whereby the magnet is rotated for selectively contacting the fluid media with the member to be charged.

Japanese Patent Application Document No. 04-109262 discloses a charging device which restrains magnetic fluid via magnetic force, wherein a magnetic fluid is interposed between a pair of conducting magnets. The structure disclosed in that publication is described as having a magnet positioned on the left and right with a retaining unit positioned at the rear to form a support frame for magnetic fluid, whereby the magnetic fluid is supported and restrained by the magnetism of the magnets positioned on the left and right.

Japanese Patent Application Document No. 05-297683 discloses a charging device comprising a liquid high resistance charging electrode, whereby a receptacle is filled with a liquid charging electrode and a high voltage power source is connected to the liquid electrode in order to complete a structure in which corona discharge develops between the liquid charging electrode and a photoreceptive drum.

U.S. patent ppplication Ser. No. 08/497,987 discloses an apparatus for applying an electrical charge to a charge retentive surface by transporting ions through an ionically conductive liquid and transferring the ions to the member to be charged across the interface between the liquid and the charge retentive surface. The ionically conductive liquid is contacted with the charge retentive surface for depositing ions onto the charge retentive surface via a wetted donor blade supported within a conductive housing, wherein the housing is coupled to an electrical power supply for applying an electrical potential to the ionically conductive liquid. In one specific embodiment disclosed therein, the charging apparatus includes a support blade for urging the donor blade into contact with the charge retentive surface and a wiping blade for wiping any liquid from the surface of the charge retentive surface as may have been transferred from the donor blade to the charge retentive surface interface.

In accordance with the present invention, a liquid charging apparatus for applying an electrical charge to a moving member is provided, comprising :ionically conductive liquid charging means, adapted to contact the moving member, for applying an electrical charge thereto by transporting ions through an ionically conductive liquid to the moving member so as to transfer ions thereto; and mechanically sealable housing means, adapted to permit movement of the ionically conductive liquid charging means from an operative position in contact with the moving member to a nonoperative position stored within the housing means to prevent loss of the ionically conductive liquid.

In accordance with another aspect of the invention, an electrostatographic printing machine including a liquid charging apparatus for applying an electrical charge to a photoconductive member is provided, comprising: ionically conductive liquid charging means, adapted to contact the photoconductive member, for applying an electrical charge thereto by transporting ions through an ionically conductive liquid to the photoconductive member so as to transfer ions thereto; and mechanically sealable housing means, adapted to permit movement of the ionically conductive liquid charging means from an operative position in contact with the photoconductive member to a nonoperative position stored within the housing means to prevent loss of the ionically conductive liquid.

These and other aspects of the present invention will become apparent from the following description in conjunction with the accompanying drawings in which.

Figure 1:
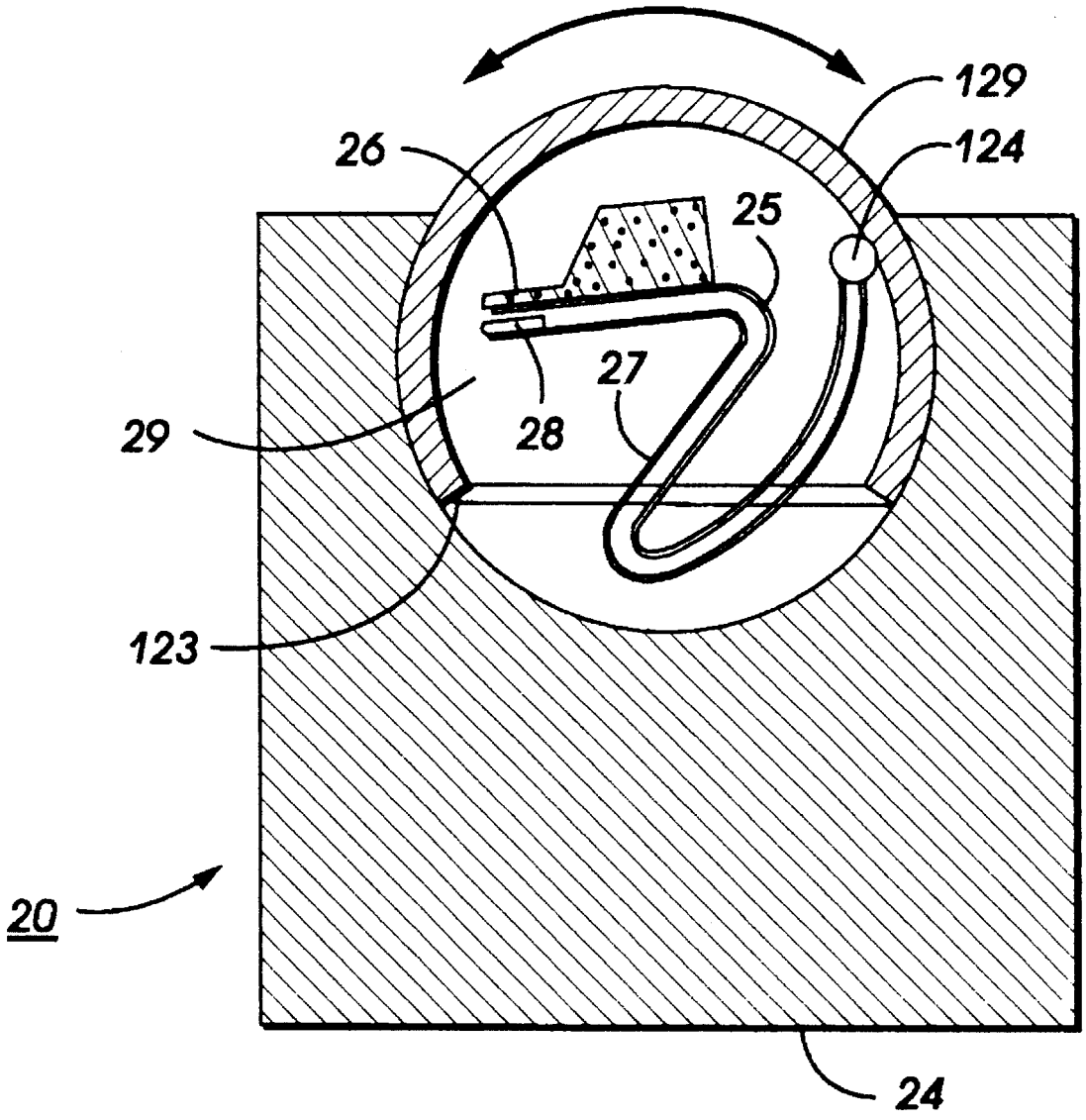
FIG. 1 is a simple cross sectional side view of the mechanically sealable ionically conductive liquid charging apparatus in accordance with the present invention.

For a general understanding of the features of the present invention, reference is made to the drawings wherein like reference numerals have been used throughout to designate identical elements. While the present invention will be described in connection with a preferred embodiment thereof, it will be understood that the invention is not limited to this preferred embodiment. On the contrary, the present invention is intended to cover all alternatives, modifications, and equivalents as may be included within the spirit and scope of the invention as defined by the appended claims.

Figure 3:
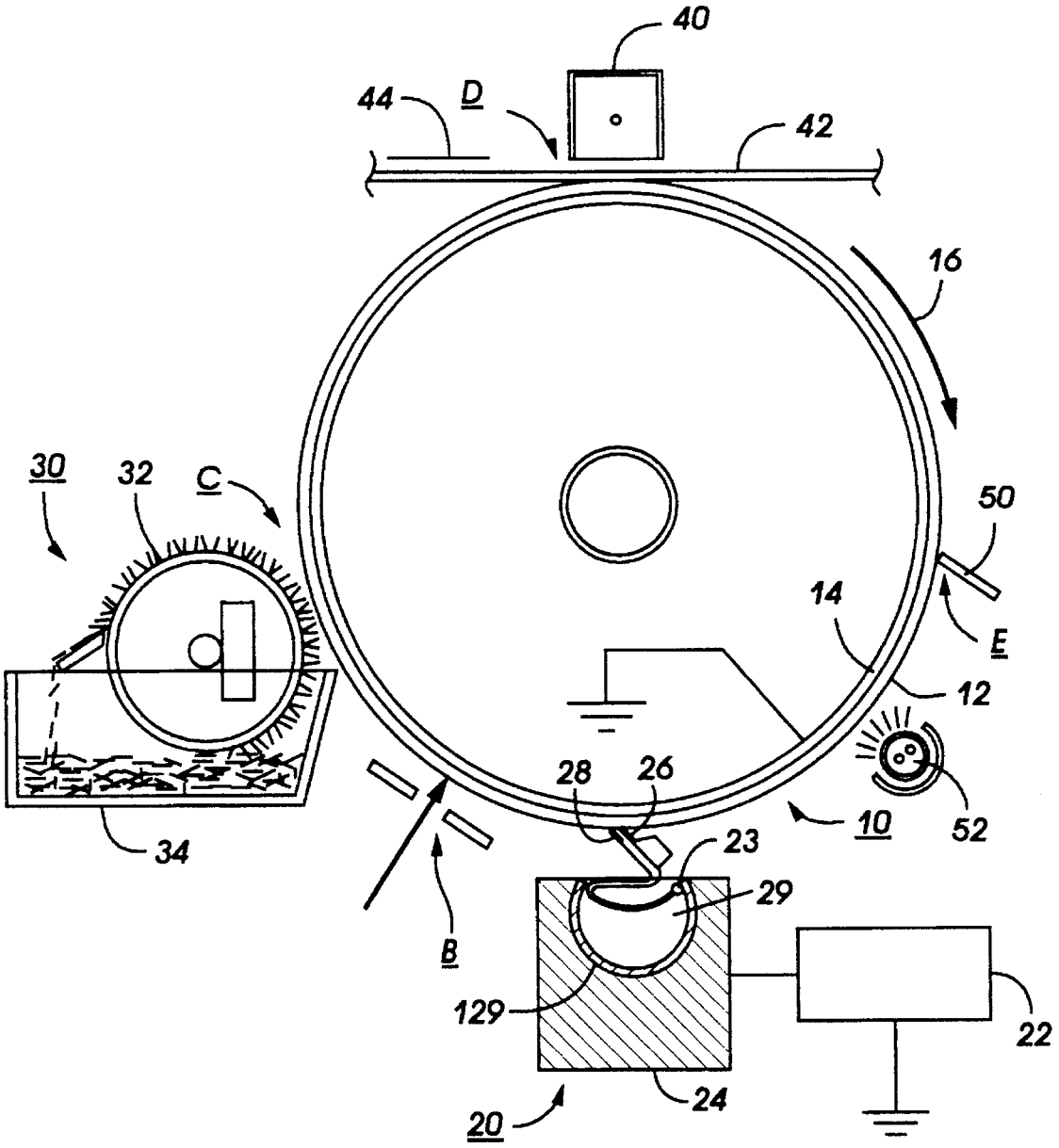
FIG. 3 is a schematic elevational view showing an electrostatographic copier employing the ionically conductive liquid charging apparatus of the present invention.

Referring initially to FIG. 3 prior to describing the invention in detail, a schematic depiction of the various components of an exemplary electrostatographic reproducing apparatus incorporating the ionically conductive liquid charging apparatus of the present invention is provided. It will be understood that, although the apparatus of the present invention is particularly well adapted for use in an automatic electrostatographic reproducing machine, the instant charging structure is equally well suited for use in a wide variety of electrostatographic-type processing machines and is not necessarily limited in its application to the particular embodiment or embodiments shown herein. In particular, it should be noted that the charging apparatus of the present invention, described hereinafter with reference to an exemplary charging system, may also be used in a transfer, detack, or cleaning subsystem of a typical electrostatographic apparatus since such subsystems also require the use of a charging device.

The exemplary electrostatographic reproducing apparatus of FIG. 3 employs a drum 10 including a photoconductive surface 12 deposited on an electrically grounded conductive substrate 14. A motor (not shown) engages with drum 10 for rotating the drum 10 in the direction of arrow 16 to advance successive portions of photoconductive surface 12 through various processing stations disposed about the path of movement thereof, as will be described.

Initially, a portion of drum 10 passes through charging station A. At charging station A, a charging device in accordance with the present invention, indicated generally by reference numeral 20, charges the photoconductive surface 12 on drum 10 to a relatively high, substantially uniform potential. In general, the charging device 20 in accordance with the present invention, comprises an apparatus adapted to contact a liquid material to the surface of drum 10, wherein a voltage is applied across the liquid as drum 10 rotates, thereby enabling the transfer of ions across the liquid/photoreceptor interface to the photoreceptor surface. The photoreceptor surface 12 thus becomes electrically charged by the transfer of ions through the liquid medium in contrast to the application of a charge via a corotron or other corona generating device. This charging device in accordance with the present invention will be described in detail following the instant discussion of the electrostatographic apparatus and process.

Once charged, the photoconductive surface 12 is advanced to imaging station B where an original document (not shown) may be exposed to a light source (also not shown) for forming a light image of the original document onto the charged portion of photoconductive surface 12 to selectively dissipate the charge thereon, thereby recording onto drum 10 an electrostatic latent image corresponding to the original document. One skilled in the art will appreciate that various methods may be utilized to irradiate the charged portion of the photoconductive surface 12 for recording the latent image thereon as, for example, a properly modulated scanning beam of energy (e.g., a laser beam).

After the electrostatic latent image is recorded on photoconductive surface 12, drum 10 is advanced to development station C where a development system, such as a so-called magnetic brush developer, indicated generally by the reference numeral 30, deposits developing material onto the electrostatic latent image. The exemplary magnetic brush development system 30 shown in FIG. 2 includes a single developer roller 32 disposed in developer housing 34, in which toner particles are mixed with carrier beads to create an electrostatic charge therebetween, causing the toner particles to cling to the carrier beads and form developing material. The developer roller 32 rotates to form a magnetic brush having carrier beads and toner particles magnetically attached thereto. As the magnetic brush rotates, developing material is brought into contact with the photoconductive surface 12 such that the latent image thereon attracts the toner particles of the developing material, forming a developed toner image on photoconductive surface 12. It will be understood by those of skill in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image in a timed sequence so that the developed image on the photoconductive surface 12 contacts the advancing sheet of support material 42 at transfer station D. A charging device 40 is provided for creating an electrostatic charge on the backside of sheet 42 to aid in inducing the transfer of toner from the developed image on photoconductive surface 12 to the support substrate 42. While a conventional coronode device is shown as charge generating device 40, it will be understood that the ionically conductive liquid charging device of the present invention might be substituted for the corona generating device 40 for providing the electrostatic charge which induces toner transfer to the support substrate materials 42. However, it will be recognized After image transfer to the substrate 42, the support material 42 is subsequently transported in the direction of arrow 44 for placement onto a conveyor (not shown) which advances the sheet to a fusing station (also not shown) which permanently affixes the transferred image to the support material 42 thereby for a copy or print for subsequent removal of the finished copy by an operator.

Often, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10. Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp (not shown) for flooding the photoconductive surface 12 with light in order to dissipate any residual electrostatic charge remaining thereon in preparation for a subsequent imaging cycle.

The foregoing description should be sufficient for purposes of the present application for patent to illustrate the general operation of an electrostatographic reproducing apparatus incorporating the features of the present invention. As described, an electrostatographic reproducing apparatus may take the form of any of several well known devices or systems. Variations of the specific electrostatographic processing subsystems or processes described herein may be expected without affecting the operation of the present invention. For example, to those skilled in the art, the photoconductive coating of the photoreceptor may be placed on a flexible belt of either seamed or unseamed construction, continuous or not, without affecting the operation of the present invention.

Referring now, more particularly, to ionically conductive liquid charging devices to which the specific subject matter of the present invention is directed, an exemplary ionically conductive liquid charging apparatus 20 will be described in greater detail. In general, an ionically conductive liquid charging device comprises an apparatus which is suitable for bringing a liquid material like distilled water or deionized water, or some other liquid material which may include a gelling agent, as will be discussed, into contact with the surface 12 of the photoreceptor 10 with a voltage being applied to the liquid material while the photoreceptor 10 is rotated or transported relative thereto, thereby enabling the transfer of ions, preferably of a single positive or negative polarity, from the liquid photoreceptor interface to the photoreceptor surface 12.

By way of background, the liquid charging apparatus of the type described operates as a means for enabling ionic conduction charging of a photoconductive imaging member, or any dielectric member placed in contact therewith, by placing an ionically conductive liquid component in contact with the surface of the photoconductive imaging member and applying a voltage to the ionically conductive liquid component such that ions are transferred across the interface between the liquid and the photoconductive surface. The photoreceptor thus becomes charged by the flow of ions through the liquid component rather than by the spraying of ions onto the photoreceptor through a gaseous media as occurs in a corotron or like corona generating device. In simplest terms, the ionically conductive liquid is biased by a voltage approximately equal to the surface potential desired on the photoreceptor, causing ions to be deposited at the point of contact between the ionic liquid and the photoreceptor until the electric field across is completely diminished.

Examples of ionically conductive liquid materials which may serve satisfactorily in the context of the present invention include any liquid based material capable of conducting ions, including simple tap water and even distilled or deionized water (where the conductivity thereof is believed to be caused by the known dissolution of carbon dioxide in water). Components which can be added to the water to render it more ionically conductive include atmospheric carbon dioxide ($CO_2$), lithium carbonate, sodium carbonate, potassium carbonate, sodium bicarbonate and the like. The concentration ranges can vary from trace levels to saturation. Another example of an ionically conductive medium is a gel that is composed of 96 wt % water and 4 wt % acrylic acid neutralized with NaOH. Other hydrogels include polyhydroxyethylmethacrylates, polyacrylates, polyvinylpyrrolidinone and the like. Other gel materials include gelatin, gums and mucilages both natural and synthetic. Numerous other fluid compounds and materials which may be desirable for use with the apparatus of the present invention are described in commonly assigned U.S. patent application entitled Photoconductive Charging Processes filed on May 27, 1994, identified by patent application Ser. No, 08/250,749.

In an exemplary embodiment, the photoreceptor is charged by wetting an electrically biased foam component placed in contact with the photoreceptor. The electrical bias causes the ions present in the ionically conductive liquid material to separate. When a positive voltage is applied from the power source, positive ions migrate toward the imaging member, and when a negative voltage is applied from the power source negative ions migrate toward the imaging member. Rotation or translation of the imaging member causes charge to transfer from the foam to the imaging member, wherein the charge is substantially equivalent to the voltage applied from the power source.

The described process is considered highly efficient when two conditions are met. The first is that of insignificant voltage drop in the ionically conductive medium or carrier (e.g. foam), which is satisfied in pure distilled water where the IR drop at 20 inches per second is no more than about 25 volts. This represents a waste of about 4 percent of the applied voltage when the applied voltage is 625 volts. The voltage drop across the ionically conductive medium can be reduced and the efficiency increased by increasing the ionic conductivity of the ionically conductive medium, which can be accomplished, for example, by adding a low concentration of an ionic species, for example, about 0.1 mM. The second condition is that the imaging member and the ionically conductive medium remain in contact for a sufficient period of time so that the voltage developed on the imaging member reaches the applied voltage less the IR drop in the ionically conductive medium. The Table that follows illustrates the calculated current expected at various process speeds. The assumptions are an applied voltage of 1,000 volts, a relative dielectric constant of 3.0, an imaging member thickness of 25 microns and a 16 inch long charging mechanism (1,000 $cm^2$/panel).

| PROCESS SPEED | CURRENT | POWER |
|---|---|---|
| 2 ips | 20 uA | 20 mW |
| 10 ips | 100 uA | 100 mW |
| 20 ips | 200 uA | 200 mW |

One advantage of ion transfer relative to a corotron is that ozone production is significantly reduced when charging layered imaging members. Contact ionic charging produces less than 1 percent of the ozone that a corotron produces. A commercial organic photoreceptor drum of diameter 3.2 inches was run at a surface speed of 48 inches per second while being charged repeatedly by the process of the present invention. Measurements of ozone concentration within one half inch of the charging zone were below the analytical detection limit of 0.005 parts per million. Since organic photoreceptors are usually charged to less than −800 volts, ion transfer charging of the present invention is for all practical purposes ozoneless. This eliminates one photoreceptor degradation mechanism, that is a print defect commonly known as parking deletions. In addition the need for ozone management and filtration is eliminated. Thus, ionic charging devices present a lower health hazard than a corotron or scorotron.

It is noted that the imaging member cannot be overcharged by the process disclosed in the present invention. The maximum voltage to which the imaging member can be charged is the voltage applied to the fluid media. The charging of the imaging member is limited to this value since the electric field across the bulk of the fluid medium, which drives the ions to the fluid/insulator interface, drops to zero when the voltage on the imaging member reaches the voltage applied to the fluid. Conversely, the imaging member can be undercharged if insufficient time is allowed for contact between the imaging member and the ionically conductive medium. The degree of undercharging is usually not significant (25–50 V) and can be compensated for by the application of a higher voltage to the ionically conductive medium. Moreover, it is noted that despite this voltage drop, the charge on the photoreceptor is uniform. The circumferential rotating speed of the photoreceptor can range from very low values like infinitesimally greater than zero speed to high speeds such as, for example, about 100 inches per second and preferably from zero to about 20 inches per second.

Another advantage of the processes of the present invention is that the complexity of the power supply can be diminished. Because it is not necessary to control the discharge of corona, only a DC voltage bias is applied to the fluid media. Thus, the power supply is simpler than typical charging systems which use an AC signal superimposed onto a DC signal. In addition, the voltages necessary to operate the present invention are lower than any other practical charging device.

Yet another advantage is the high degree of charge uniformity provided by the present invention. It is believed that the potential distribution on the dielectric being charged adjusts itself during the charging process in such a way that the undercharged areas tend to become "filled in" with the additional ions, leading to a uniform deposition of ions on the dielectric layer. It has been shown that the variation in surface voltage is essentially at or below the measurement accuracy of plus or minus 1 to 2 volts over a Mylar surface. The device has also been shown to be capable of uniformly charging a photoreceptor surface up to 50 inches per second.

Moving now to the specific subject matter of the present invention, one embodiment of a mechanically sealable liquid charging apparatus in accordance with the present invention is directed toward the problem of liquid loss, either as a liquid or as a vapor, which poses a serious problem in an ionically conductive liquid charging apparatus of the type described hereinabove. Loss of liquid from the device, especially under conditions in which the electrostatographic printing machine is at rest or in a non-printing state, will disable the device in a short period of time relative to the anticipated field life of the device. As a solution to this problem, the ionically conductive liquid charging apparatus of the present invention includes a sealable housing 24 adapted to support a wetted liquid donor wick 26 in contact with the surface 12 of photoreceptor 10 via a resilient spring arm 25 having the donor wick 26 mounted thereon, wherein the sealable housing is adapted to permit movement of the donor wick 26/spring arm 25 combination from an operative position in contact with the photoconductive surface to a nonoperative position stored within the housing for preventing loss of ionically conductive liquid.

In one embodiment of the present invention, as shown in FIGS. 1 and 3, housing 24 defines a housing cavity 29, including a housing aperture 23 extending transverse to and facing photoreceptor 12. A sleeve member 129, having a sleeve aperture extending transverse to the photoreceptor 12 is situated within the cylindrical housing cavity 29. The sleeve member 129 is rotatable in the housing cavity 29, such that alignment of housing aperture 23 and sleeve aperture 123 creates an opening in the housing 24 for deploying the donor wick 26 to the photoreceptor 10 with the donor wick 26 in the operative position. Conversely, rotation of the sleeve member 129 such that housing aperture 23 and sleeve aperture 123 are misaligned creates a closure along housing aperture 123 for mechanically sealing the housing 24 with the donor wick 26 in the nonoperative position. Preferably, sleeve 129 is oriented within housing cavity 29 such that apertures 23 and 123 are 180° out of alignment, for creating an optimal seal along the elongated seal of the housing 24.

Figure 2:
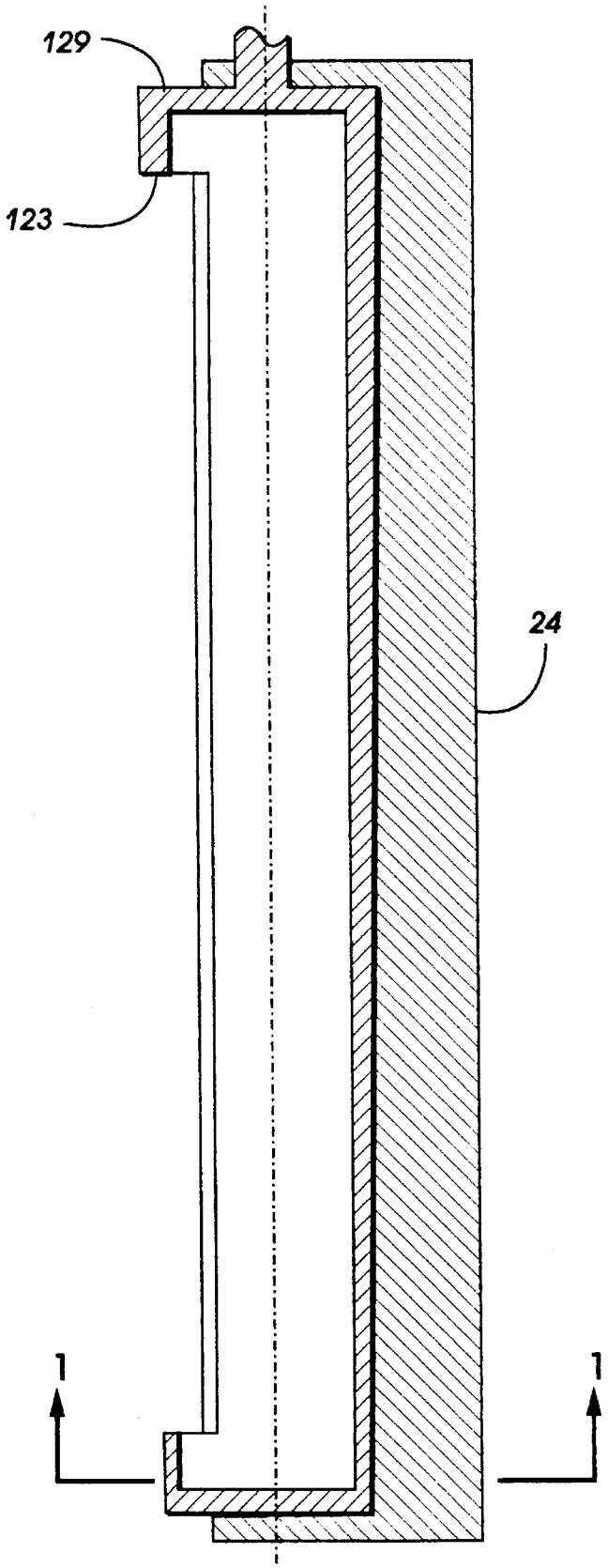
FIG. 2 is a plan view of a locking taper seal embodiment of the mechanically sealable liquid charging apparatus of the present invention.

While the embodiment of FIGS. 1 and 3 contemplates the use of a concentric, substantially cylindrical pair wherein a substantially cylindrical sleeve member 129 is nested within a substantially cylindrical cavity 29, it has been found that it may be difficult to manufacture such a cylindrical pair under a design constraint which requires that the sleeve member and cavity must be rotatable with respect to one another while being capable of forming an air tight seal when properly oriented. This problem is exacerbated by an additional desirable design feature wherein one or both of either the housing 24 or the sleeve 129 may be fabricated from a conformable material, which may make rotation relative to one another very difficult. Thus, as an alternative to the concentric cylinder pair design of the embodiment shown in FIGS. 1 and 3, the present invention also contemplates an alternative embodiment as illustrated in FIG. 2. In this alternative embodiment, The housing cavity 29 and sleeve 129 each respectively include a taper extending along the longitudinal axis thereof, transverse to the path of movement of the photoconductive member. Thus, both the housing cavity 29 and the sleeve 129 each have a diameter which gradually and continuously decreases from one end to the opposite end. In this embodiment, the sleeve member 129 is pulled off of the taper just prior to rotation thereof to position the sleeve aperture 123 into alignment with the housing aperture 23 for placing the donor wick 26 in the operative position. Conversely, after rotation of the sleeve member 129 for placing the donor wick 26 in the nonoperative position, the tapered sleeve 129 is pushed inward along the longitudinal axis thereof to press the sleeve onto the taper of the housing cavity 29, thereby forming an airtight seal between the housing aperture 23 and the sleeve 129. This "tapered pair" design is recognized in the machine trade as a "locking taper," and is known as an arrangement which will not slip under heavy torques. Thus, this alternative embodiment provides the benefits of an efficient seal while providing unencumbered rotation of the sleeve 129 relative to the housing cavity 29 at the cost of some additional complexity in the mechanical operation of the system. It will be recognized that the required rotational movement and longitudinal displacement of the sleeve member can be provided via various electomechanical devices as are well known in the art such as a stepper motor and a solenoid, respectively.

In operation, the mechanically sealable liquid charging device is configured in the nonoperative position when charging of the photoreceptor is not required, as shown in FIG. 2 (for example when the machine is powered off). In the nonoperative position, sleeve 129 is oriented such that the sleeve aperture 123 is approximately 180° out of alignment with housing aperture 23. Upon activation of the machine, such that charging of the photoreceptor is required, sleeve 129 is rotated (preferably counterclockwise with respect to the embodiment illustrated in FIG. 1). Rotation of sleeve 129 causes sleeve aperture 123 to come into alignment with housing aperture 23 which, in turn, allows donor wick 26 to be deployed from the housing under the urging force of spring arm 25, which exerts a force against the interior wall of sleeve 129, inducing wick 26 to pivot about fixed pivot axis 124. A voltage may be applied to this pivot axis 124 for applying a voltage to the wick 26, as will be described. By contrast, upon machine deenergization, or after photoreceptor charging is no longer necessary, sleeve 129 is rotated once again (preferably in the clockwise direction relative to the embodiment illustrated in FIG. 1). Rotation of sleeve 129 under these circumstances causes sleeve aperture 123 to move out of alignment with housing aperture 23 to seal the housing 24. In addition, the reverse rotation of the sleeve 129 operates to transport the lead edge of the sleeve into contact with the donor wick 26, with additional rotation of the sleeve resulting in the shifting of the wick 26 from the operative position in contact with the photoreceptor 12, to a nonoperative position concealed within the sealed housing 24. It will be recognized by those of skill in the art that, although the present invention is described in terms of a sleeve being rotated within a cavity, the advantages of the present invention may be achieved via an apparatus wherein the housing and cavity thereof are adapted to rotate relative to a stationary sleeve member. Thus, the present invention encompasses the concept of a liquid charging apparatus comprising a sleeve member adapted to be rotatably mounted relative to and within a housing cavity, wherein the sleeve member defines a sleeve aperture extending transverse to the moving member and either the housing or the sleeve member being rotatable relative to one another for forming a sealable housing.

The resilient spring arm 25 is comprised of a conductive material and is coupled to a DC voltage power supply 22 for applying an ion transporting bias voltage to the wetted donor wick 26, whereby a voltage bias is applied to the liquid donor wick 26 and the ionically conductive liquid material wetted thereby via DC power supply 22. Alternatively, electrical contact can also be made to the ionically conductive fluid by immersing an electrical wire into the wick 26 along the length thereof. Typical voltages provided by the power supply 22 might range from about −4000 V to about +4000 V, and preferably between about ±400 to about ±700. The voltage that is applied to the photoreceptor surface 12 is essentially equal to the voltage applied to the ionically conductive liquid such that a voltage of 750 volts, for example, applied to the ionically conductive medium results in a voltage of about 750 volts or slightly less on the photoreceptor surface. The voltage supplied by the power source 22 can be of a positive or negative polarity, wherein the polarity of the charge deposited by the donor wick 26 is exclusively controlled by the polarity of the supplied voltage. That is to say that the application of a positive bias to the ionically conductive liquid material causes positive ions to transfer to the photoconductive member while the application of a negative bias to the ionically conductive liquid causes negative ions to transfer to the photoconductive member.

Donor wick 26 is a relatively flexible, compliant member which may be fabricated from a porous or microporous elastomeric polymer like polyurethane or polyvinylalcohol-co-polyvinylformal (polyvinylalcohol crosslinked with formaldehyde) which permits ionically conductive liquid to be brought into contact with the photoreceptor surface 12. This blade member should be wettable, preferably hydrophilic especially when the liquid is water, by the particular ionically conductive liquid being utilized. For example, polyurethane foam, compressed polyurethane foam, or polyvinylalcohol-co-polyvinylformal foam can be used to provide a compliant blade member. Alternatively, the donor wick 26 can be fabricated from a hydrophobic polymer, for example VITON®, a copolymer of vinylidene fluoride/hexafluoropropylene, or terpolymers of vinylidene fluoride/hexafluoropropylene and tetrafluoroethylene. The surface of the wick can be chemically treated so as to make it hydrophilic. For example, it may be treated by exposure to ozone gas, or other oxidizing agents such as chromic acid. Yet another known process for making the surface of a nonhydrophiliz material, such as VITON®, hydrophilic is to roughen it, for example by sanding it with fine sand paper. Other hydrophobic polymers which may be utilized for the donor wick include polyethylene, polypropylene, polyethylpentane, polybutadiene and silicone elastomers.

In addition to the donor wick 26, the structure of the present invention also includes a wiper blade 28 mounted to a second resilient spring arm 27, wherein the wiper blade 28/spring arm 27 combination can be selectively rotated into contact with the photoreceptor surface in a manner similar to the arrangement provided for donor wick 26/spring arm 25. The wiper blade 28 is provided for removing any small amount of fluid from the surface of the photoreceptor 12, as may have been transferred thereto at the interface between the wetted donor wick 26 and the photoreceptor surface 12. Thus, a polyurethane type blade situated downstream from the donor wick 26 relative to the direction of travel 16 of the photoreceptor surface 12 is provided for eliminating transfer of water or other liquid to the photoreceptor surface. The use of a wiper blade also advantageously permits a higher concentration of liquid to be applied by the donor wick 26. Clearly, the effectiveness of the wiper blade 28 can be enhanced by optimizing such factors as the liquid concentration at the donor wick 26/photoreceptor surface 12 interface, the wipe angle of the wiper blade 28 as well as the stiffness of the spring arm 27. The wiper blade 28 also provides increased operational lifetime to the charging system of the present invention by returning the ionically conductive liquid to the housing 24 for use in successive charging operations. It will be understood from the foregoing description that the housing 24, and, in particular, cylindrical cavity 29, may also serve as a reservoir for storing an amount of the ionically conductive liquid used to wet the liquid donor wick 26 supported therein. Alternatively, or in addition, a liquid management system (not shown) may be provided for adding liquid to the housing 24 of the charging apparatus for continually moistening the donor blade.

In review, the present invention is directed to an apparatus for charging photoreceptors by the transfer of ions thereto from an ionically conductive medium, wherein this medium is comprised of a liquid material including deionized water or distilled water, or an ionically conductive liquid or gel and a process for the ion transfer charging of photoconductive imaging members which comprises contacting an ionically conductive medium with the surface of the photoreceptor. A voltage is applied to the ionically conductive liquid medium while translating or rotating the photoreceptor past the ionically conductive medium, thereby enabling the transfer of ions to the photoreceptive member. A mechanically sealable housing is provided, the housing being adapted to permit movement of the ionically conductive liquid charging member from an operative position in contact with the photoconductive imaging member, to a nonoperative position stored within the housing to prevent loss of the ionically conductive liquid in its liquid or vapor form so as to extend the functional life of the apparatus. In addition, a wiper blade may be provided for removing any liquid droplets from the surface of the photoreceptor as may have been transferred thereto by the donor blade.

It is, therefore, apparent that there has been provided, in accordance with the present invention, an ionically conductive liquid charging device that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

I claim:

1. A liquid charging apparatus for applying an electrical charge to a moving member, comprising:

ionically conductive liquid charging means, adapted to contact the moving member, for applying an electrical charge thereto by transporting ions through an ionically conductive liquid to the moving member so as to transfer ions thereto; and mechanically sealable housing means, adapted to permit movement of said ionically conductive liquid charging means from an operative position in contact with the moving member to a nonoperative position stored within said housing means to prevent loss of the ionically conductive liquid.

2. The liquid charging apparatus of claim 1, wherein said ionically conductive liquid charging means includes:

a donor member wetted with an ionically conductive liquid material; and means for applying an electrical bias to said wetted donor member, wherein the electrical bias transports ions through said ionically conductive liquid to the moving member for transferring ions thereto.

3. The liquid charging apparatus of claim 2, wherein:

said mechanically sealable housing means defines a housing cavity which further defines a housing aperture extending transverse to the moving member, and said liquid charging apparatus further comprises a sleeve member adapted to be rotatably mounted relative to and within the housing cavity, said sleeve member defining a sleeve aperture extending transverse to the moving member, wherein said sleeve member is rotatable relative to the housing cavity for forming a seal along said housing aperture with said donor member in the nonoperative position, and forming an opening for deploying said donor member from said housing with said donor member in the operative position, the housing aperture and the sleeve aperture being in substantial alignment with one another.

4. The liquid charging apparatus of claim 2, wherein said donor member comprises:

a wick member imbibed with ionically conductive liquid for being contacted with the moving member;

a resilient support arm having said wick mounted thereon; and a pivot axis having said resilient support arm mounted thereto, said resilient support arm being adapted to rotate about said pivot axis for permitting movement of said ionically conductive liquid charging means from the operative position to the nonoperative position.

5. The liquid charging apparatus of claim 2, further including a wiper blade for removing any amount of ionically conductive liquid from the moving member after charging thereof.

6. The liquid charging apparatus of claim 3, wherein:

the housing cavity is substantially cylindrical in shape; and the sleeve member is substantially cylindrical in shape such that the housing cavity and the sleeve member form a substantially concentric cylindrical pair.

7. The liquid charging apparatus of claim 6, wherein:

the substantially cylindrical shape of the housing cavity includes a taper along an axis transverse to the moving member; and the substantially cylindrical shape of the sleeve member includes a taper along an axis transverse to the moving member such that the housing cavity and the sleeve member form a locking taper mechanism.

8. The liquid charging apparatus of claim 1, wherein the moving member includes a photoconductive imaging member.

9. The liquid charging apparatus of claim 2, wherein said means for applying an electrical bias to said ionically conductive liquid includes a DC voltage power supply.

10. The liquid charging apparatus of claim 3, further including means for rotating said said sleeve member within the housing cavity for moving said ionically conductive liquid charging means from the operative position to the nonoperative position.

11. An electrostatographic printing apparatus including a liquid charging apparatus for applying an electrical charge to a photoconductive imaging member, comprising:

ionically conductive liquid charging means, adapted to contact the moving member, for applying an electrical charge thereto by transporting ions through an ionically conductive liquid to the moving member so as to transfer ions thereto; and mechanically sealable housing means, adapted to permit movement of said ionically conductive liquid charging means from an operative position in contact with the moving member to a nonoperative position stored within said housing means to prevent loss of the ionically conductive liquid.

12. The electrostatographic printing apparatus of claim 11, wherein said ionically conductive liquid charging means includes:

a donor member wetted with an ionically conductive liquid material; and means for applying an electrical bias to said wetted donor member, wherein the electrical bias transports ions through said ionically conductive liquid to the photoconductive imaging member for transferring ions thereto.

13. The electrostatographic printing apparatus of claim 12, wherein:

said mechanically sealable housing means defines a housing cavity which further defines a housing aperture extending transverse to the moving member, and said liquid charging apparatus further comprises a sleeve member adapted to be rotatably mounted relative to and within the housing cavity, said sleeve member defining a sleeve aperture extending transverse to the moving member, wherein said sleeve member is rotatable relative to the housing cavity for forming a seal along said housing aperture with said donor member in the nonoperative position, and forming an opening for deploying said donor member from said housing with said donor member in the operative position, the housing aperture and the sleeve aperture being in substantial alignment with one another.

14. The electrostatographic printing apparatus of claim 12, wherein said donor member comprises:

a wick member imbibed with ionically conductive liquid for being contacted with the photoconductive imaging member;

a resilient support arm having said wick mounted thereon; and a pivot axis having said resilient support arm mounted thereto, said resilient support arm being adapted to rotate about said pivot axis for permitting movement of said ionically conductive liquid charging means from the operative position to the nonoperative position.

15. The electrostatographic printing apparatus of claim 12, further including a wiper blade for removing any amount of ionically conductive liquid from the photoconductive imaging member after charging thereof.

16. The electrostatographic printing apparatus of claim 13, wherein:

the housing cavity is substantially cylindrical in shape; and the sleeve member is substantially cylindrical in shape such that the housing cavity and the sleeve member form a substantially concentric cylindrical pair.

17. The electrostatographic printing apparatus of claim 16, wherein:

the substantially cylindrical shape of the housing cavity includes a taper along an axis transverse to the moving member; and the substantially cylindrical shape of the sleeve member includes a taper along an axis transverse to the moving member, such that the housing cavity and the sleeve member form a locking taper mechanism.

18. The electrostatographic printing apparatus of claim 12, wherein said means for applying an electrical bias to said ionically conductive liquid includes a DC voltage power supply.

19. The electrostatographic printing apparatus of claim 13, further including means for rotating said said sleeve member within the housing cavity for moving said ionically conductive liquid charging means from the operative position to the nonoperative position.

* * * * *